US011554592B2

(12) United States Patent
Svoboda et al.

(10) Patent No.: US 11,554,592 B2
(45) Date of Patent: Jan. 17, 2023

(54) METHOD OF PRINTING AT LEAST TWO PRINT JOBS ON ONE PRINTING MACHINE

(71) Applicant: Heidelberger Druckmaschinen AG, Heidelberg (DE)

(72) Inventors: Petra Svoboda, Nussloch (DE); Nikolaus Pfeiffer, Heidelberg (DE); Stefan Bollmann, Hamburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 17/741,690

(22) Filed: May 11, 2022

(65) Prior Publication Data

US 2022/0363074 A1 Nov. 17, 2022

(30) Foreign Application Priority Data

May 11, 2021 (DE) ..... 10 2021 112 243.0

(51) Int. Cl.

| | |
|---|---|
| ***B41J 3/54*** | (2006.01) |
| ***B41F 33/00*** | (2006.01) |
| ***B41J 2/175*** | (2006.01) |
| ***B41F 33/10*** | (2006.01) |
| ***B41F 1/16*** | (2006.01) |

(52) U.S. Cl.

CPC ..... *B41J 3/543* (2013.01); *B41F 1/16* (2013.01); *B41F 33/0045* (2013.01); *B41F 33/10* (2013.01); *B41J 2/175* (2013.01)

(58) Field of Classification Search

CPC .. B41J 2/175; B41J 3/543; B41J 3/546; B41F 1/0036; B41F 1/16; B41F 33/0045; B41F 33/045; B41F 33/10

See application file for complete search history.

(56) References Cited

U.S. PATENT DOCUMENTS

| | | | | |
|---|---|---|---|---|
| 5,662,044 | A * | 9/1997 | Loffler | H04N 1/603 101/142 |
| 6,580,524 | B1 | 6/2003 | Weichmann et al. | |
| 6,999,200 | B2 * | 2/2006 | Shiraishi | B41F 33/0036 358/1.9 |
| 2007/0209541 | A1 | 9/2007 | Kiyohara et al. | |
| 2014/0192371 | A1 * | 7/2014 | Teraue | G06K 15/1878 358/1.9 |

FOREIGN PATENT DOCUMENTS

DE 10223479 B4 5/2010

* cited by examiner

*Primary Examiner* — Anh T Vo

(74) *Attorney, Agent, or Firm* — Laurence A. Greenberg; Werner H. Stemer; Ralph E. Locher

(57) ABSTRACT

A method includes the steps of: a) printing a first print job on a printing machine using a printing fluid, a substrate, a specified ICC profile, and a first machine setting; b) preparing the printing operation of a second print job involving a change of the printing fluid and/or of the substrate; and c) printing the second print job using a second combination of printing fluid and substrate. Step b) includes: b1) printing a test print having a plurality of test fields; b2) recording the test fields; b3) computationally determining and saving a quality value based on the test fields; b4) determining and saving an adjustment value for a machine setting; and b5) selectively changing a printing machine setting from the first machine setting to a second machine setting using the adjustment value or keeping the first printing machine setting, and the making a choice based on a quality value.

10 Claims, 4 Drawing Sheets

METHOD OF PRINTING AT LEAST TWO PRINT JOBS ON ONE PRINTING MACHINE

CROSS-REFERENCE TO RELATED APPLICATION

This application claims the priority, under 35 U.S.C. § 119, of German Patent Application DE 10 2021 112 243.0, filed May 11, 2021; the prior application is herewith incorporated by reference in its entirety.

FIELD AND BACKGROUND OF THE INVENTION

The invention relates to a method of printing at least two print jobs on one printing machine and has the features described in the preamble of the independent claim.

The technical field of the invention is the field of the graphic industry and in particular the field of adjusting or calibrating a printing machine in between print jobs, in particular a printing machine with printing formes or printing heads, when a change of machine settings is carried out, for instance when printing fluids and/or substrates are changed.

ICC profiles and their usage are known in the art. An ICC profile is a standardized set of data describing the color space of a color input or color output device such as a printing machine and may be used in color space transformation. An ICC profile may, for instance, be used in the context of a color management system of a printing machine to ensure that when an original is to be reproduced, the print job is implemented in such a way that the resultant printed product matches the original—at least within the quality specifications that apply to the particular print job.

German patent DE 10 223 479 B4 discloses a method of controlling colors in a printing machine on the basis of device-independent color values, namely a method of controlling colors in a printing machine by means of actuators wherein printing parameters provided by the print preparation department are transmitted to a computing device of the printing machine, setting parameters of the actuators are calculated on the basis of the printing parameters provided by the print preparation department, and the setting parameters are made available to a machine control unit for controlling the actuators. The method is characterized in that the transmitted printing parameters provided by the print preparation department comprise printing machine-dependent target tone values and in that using at least one ICC color profile associated with the printing machine, a target color value of printing colors is determined for every target tone value. A particular step in this process may in particular be assessing the quality of the print.

In the prior art, a printing machine is calibrated for instance in accordance with print quality specifications such as dot gain or gray balance when the printing fluid and/or the printing substrate is changed. In this process, printing machines are calibrated in such a way that the individual color halftones or the gray areas correspond to specified values. In this process, a task of the calibration is for instance to adapt individual measuring fields of a test print to a specified parameter such as dot gain. However, the result is not always satisfactory.

SUMMARY OF THE INVENTION

Therefore, an object of the present invention is to provide an improvement over the prior art and in particular to ensure that when a printing machine needs to be adjusted (or calibrated) in between print jobs and requires a change of machine settings, for instance when printing fluids and/or printing substrates are changed, the printed products created as a result are of satisfactory quality.

Solution in Accordance with the Invention

In accordance with the invention, this object is attained by a method in accordance with the independent method claim.

Advantageous and thus preferred further developments of the invention will become apparent from the dependent claims as well as from the description and drawings.

A method of the invention of printing at least two print jobs on one printing machine includes the steps of: a) printing a first print job on the printing machine using a first combination of printing fluid and substrate, a specified ICC profile, and a first machine setting of the printing machine; b) preparing the printing operation of a second print job involving a change of the printing fluid and/or of the substrate to a second combination of printing fluid and substrate; and c) printing the second print job on the printing machine using the second combination of printing fluid and substrate. The invention is characterized in that step b) further includes the substeps of: b1) printing a test print on the printing machine, the test print having a plurality of test fields, using the second combination of printing fluid and substrate, the specified ICC profile, and the first machine setting in the process; b2) recording all or at least a selection of the test fields of the test print using a device for recording; b3) computationally determining and saving a quality value on the basis of the recorded test fields; b4) computationally determining and saving at least one adjustment value for a machine setting; and b5) selectively changing a setting of the printing machine from the first machine setting to a second machine setting using the adjustment value or selectively keeping the first machine setting of the printing machine, wherein the choice is made as a function of the quality value. Finally, step c) further includes printing the second print job using the second combination of printing fluid and substrate, the specified ICC profile, and—depending on the choice made in step b)—the first machine setting or the second machine setting.

Advantageous Embodiments and Effects of the Invention

The invention advantageously provides a way of adjusting (or calibrating) a printing machine in between print jobs which involve changes of machine settings such as a change of printing fluid and/or substrate in such a way that the printed products created as a result are of satisfactory print quality.

In a manner different than the prior art, the adjustment (or calibration) of a printing system, in particular a printing machine, i.e. the adjustment of the machine, upon a printing fluid and/or printing substrate change is not done in accordance with print quality specifications such as dot gain or gray balance but in such a way that an ICC profile (or: a predefined ICC profile or a selected ICC profile) may be used essentially without modification. Thus, in contrast to the prior art, it is not the job of the adjustment or calibration to adapt individual measuring fields of a test print to a predefined criterion such as dot gain but instead to adapt the printing machine or rather the machine settings thereof to a specific ICC profile, for instance by minimizing color deviations between the print and the specification by means of the ICC profile. Due to the invention, complex and time-consuming modifications to the ICC profile may be avoided.

This is likewise true with modifications to the ICC profile that cannot be done due to a lack of time, for instance when the substrate for the second print job is not available until shortly before the printing operation starts.

The substrate may be paper, cardboard, foil (plastic or metal), or labeling material. The substrate may be in the form of sheets or a web.

The printing fluid may be printing ink such as offset printing ink or inkjet printing ink, particularly UV-curable offset or inkjet printing ink, or may be a toner.

The printing fluid change may involve changing the printing fluid itself and/or changing the halftone used to apply the printing fluid to the substrate.

The ICC profile may be a conventional ICC profile, in particular an ICC profile for a printing machine such as an offset printing press or a toner printing machine or an ink printing machine.

The first and/or second machine setting may be a single setting or a set of settings for the printing machine such as a volume of ink or toner to be applied. The same applies to the adjustment value.

Changing the printing fluid and/or the substrate from a first combination of printing fluid and substrate to a second combination of printing fluid and substrate may be done automatically, for instance controlled by a digital computer. Alternatively, the change may be made manually.

When the combination of printing fluid and substrate is changed, the specified ICC profile and the first machine setting remain essentially unchanged, i.e. potential changes to the ICC profile and/or to the first machine setting which are not due to changing the printing fluid and/or changing the substrate are disregarded as they are inessential in this context.

The quality value may preferably be the following: the sum total of all color deviations of the recorded n test fields of the test print from their target values, i.e. total(dE(i)), wherein n is the number of recorded test fields and dE(i) is the color deviation of the i-th test field from its target value. The target values have preferably been specified in advance.

Alternatively, the quality value may preferably be the following: the average color deviation or a weighted average of the color deviation of the recorded n test fields of the test print, i.e. 1/n*total(dE(i)) or 1/total(weight(i))*total (dE(i) *weight(i)), wherein n is the number of recorded test fields, dE(i) is the color deviation of the i-th test field from its target value and weight(i) is the weighting factor of the i-th test field. The target values and the weighting factors have preferably been specified in advance.

Another option is to directly average (with or without weighting) the changes resulting from the recorded n test fields of the test print.

As a further option to be selected, step part b5) may include outputting a warning for instance when the result that may be attained in the second print job (printed product and/or printed image) would not be acceptable in terms of quality. Any further proceedings may be determined by the operator: selecting M1 or M2; or replacing M2 with M2*, making further quality-ensuring changes to the machine settings.

Instead of just one test print, a number of test prints may be printed.

Further Developments of the Invention

The following paragraphs describe preferred further developments of the invention (in short: further developments).

A further development may be characterized in that the first print job and the second print job are identical. A further development may be characterized in that the first print job and the second print job are different. In this context, "print job" is understood to mean the image to be printed and/or the data thereof. The printing fluid and/or the substrate may be changed, i.e. may change, even for identical print jobs.

A further development may be characterized in that the first printing fluid is a first printing ink or toner or a first set of printing inks or toners and the second printing fluid is a second printing ink or toner or a second set of printing inks or toners. The printing inks may preferably be offset printing inks. A set of printing inks may include the process colors of CMYK (cyan, magenta, yellow, black) and special colors if desired.

A further development may be characterized in that the first printing ink or toner and the second printing ink or toner are the same or that the first set of printing inks or toners and the second set of printing inks or toners are the same. A further development may be characterized in that the first printing ink or toner and the second printing ink or toner are different from one another or that the first set of printing inks or toners and the second set of printing inks or toners are different from one another. The printing inks may preferably be offset printing inks. For instance, sets of printing inks or toners of different manufacturers may be used.

A further development may be characterized in that the second machine setting includes a change of the volume of the printing ink or toner or of the volume of at least one printing ink or toner of the set of printing inks or toners compared to the first machine setting, the change based on the adjustment value.

A further development may be characterized in that step a) utilizes a first printing forme or a set of first printing formes. The first printing forme or the first set of printing formes may be created by a platesetter. The creation may take place before step a. The printing forme may be a printing plate such as an offset printing plate.

A further development may be characterized in that step b5) further includes step b5a) of creating a second printing forme or a set of second printing formes. A further development may be characterized in that the second printing forme or set of second printing formes is created in such a way that it may apply the modified volume of printing ink to the substrate. A further development may be characterized in that the step of creating includes exposing, using the adjustment value or a value corresponding to or calculated from the latter. A further development may be characterized in that step c) utilizes the second printing forme or the set of second printing formes. Thus, in the course of the adjustment (or calibration, in particular single-channel calibration), a different printing forme or set of printing formes than the first printing forme/the first set of printing formes is preferably created and subsequently utilized to apply different volumes of ink. However, the ICC profile remains essentially unchanged. The printing forme may be a printing plate such as an offset printing plate.

A further development may be characterized in that the first printing fluid is a first printing ink or a first set of printing inks and the second printing fluid is a second printing ink or a second set of printing inks. The inks may preferably be inkjet inks and more preferably UV-curable inkjet inks. A set of inks may comprise the CMYK process colors (cyan, magenta, yellow, black) and potential special colors if desired.

A further development may be characterized in that the first ink and the second ink are the same inkjet inks or that the first set of inks and the second set of inks are the same set of inkjet inks. A further development may be characterized in that the first ink and the second ink are different inkjet inks or that the first set of inks and the second set of inks are different sets of inkjet inks. For instance, sets of inks of different manufacturers may be used.

A further development may be characterized in that the second machine setting contains changing the volume of ink or the volume of at least one ink of the set of inks compared to the first machine setting, using the adjustment value to make the change.

A further development may be characterized in that step b5) further includes a step b5b) of changing the calibration of printing heads of the printing machine. The calibration may be done on the basis of a characteristic calibration curve. Thus the adjustment (or calibration, in particular a single-channel calibration) preferably includes generating and subsequently using a different characteristic calibration curve for the printing heads to apply different volumes of ink. However, the ICC profile remains essentially unchanged. A specific characteristic curve may be generated for every printing head.

A further development may be characterized in that the test print comprises a media wedge. The media wedge may form the test fields, at least the selected test fields, or it may be provided in addition to the test fields. A further development may be characterized in that the media wedge is a Fogra media wedge.

A further development may be characterized in that the changing of the setting of the printing machine may be done automatically, for instance by a digital computer. A further development may be characterized in that the changing of the setting of the printing machine may be done manually.

A further development may be characterized in that the device is a camera. A further development may be characterized in that the device for recording is a spectrometer.

A further development may be characterized in that the step of computationally determining and saving the quality value is done by means of a digital computer. A further development may be characterized in that the step of computationally determining and saving the adjustment value is done by means of a digital computer.

When reading the claim language, the following definitions apply. When the claim language recites A and/or B it means A alone, B alone or A and B. When the claim language recites at least one of A and B it means A alone, B alone or A and B. When the claim language recites at least one of A or B it means A alone, B alone or A and B.

Other features which are considered as characteristic for the invention are set forth in the appended claims.

Although the invention is illustrated and described herein as embodied in a method of printing at least two print jobs on one printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE FIGURES

FIG. 1 illustrates steps a to c;

DETAILED DESCRIPTION OF THE INVENTION

In the figures, corresponding features have the same reference symbols. Repetitive reference symbols have sometimes been left out for reasons of visibility.

Figure 1:
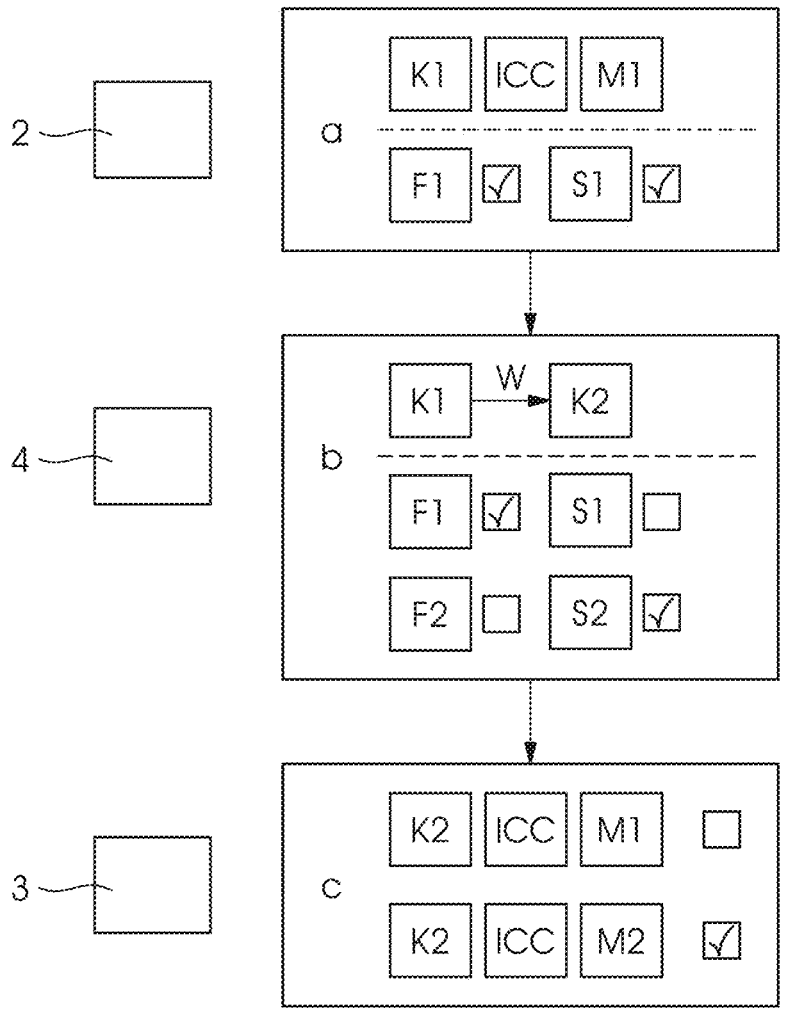
FIG. 1 illustrates details of a preferred exemplary embodiment of a method of printing at least two print jobs on a printing machine.
Figure 2:
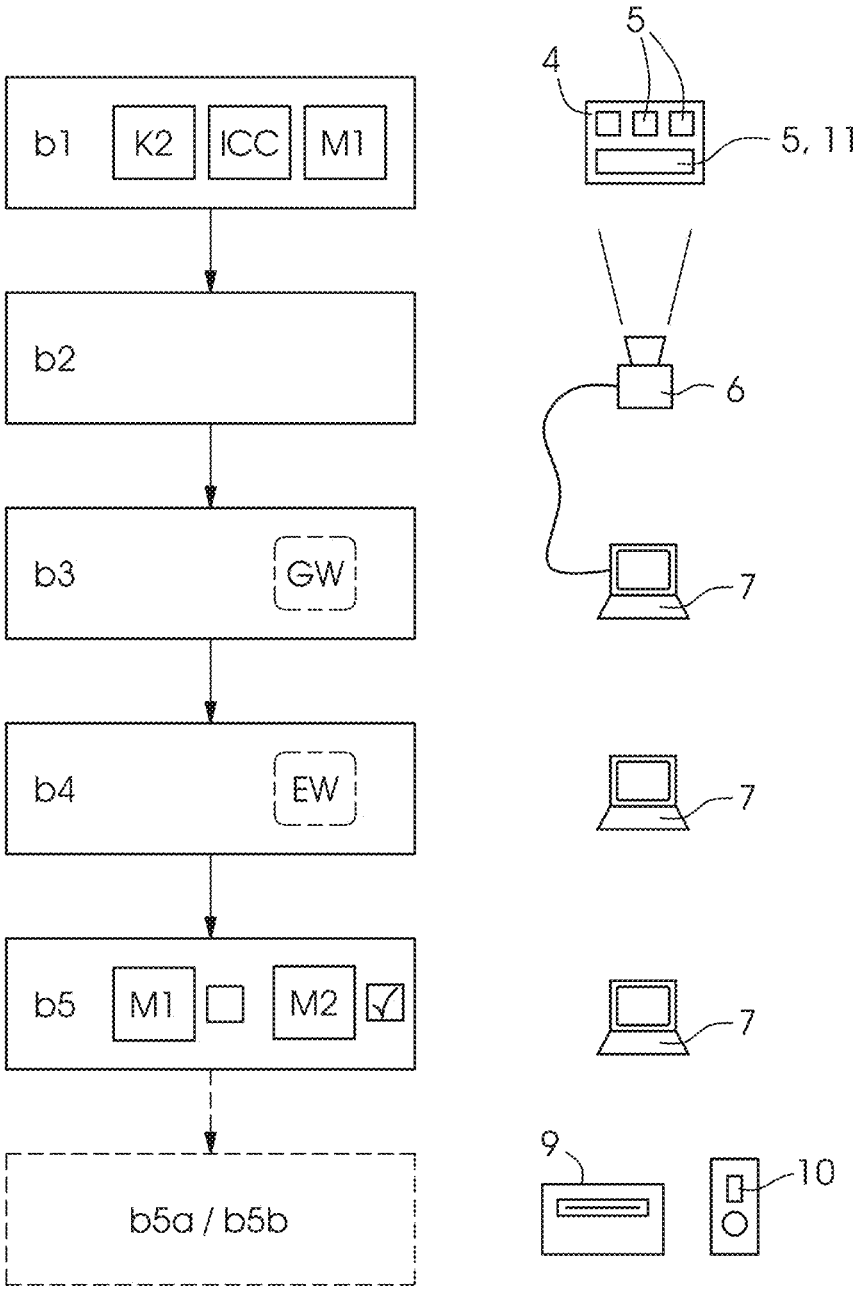
FIG. 2 illustrates steps b1 to b5 and optionally to steps b5a or b5b of the method of printing at least two print jobs.

Referring now to the figures of the drawings in detail and first, particularly to FIG. 1 thereof, there is shown in step a) printing (a) of a first print job 2 on a printing machine 1 (cf. FIG. 3) using a first combination K1 of printing fluid and printing substrate, a specified ICC profile ICC, and a first machine setting M1 of the printing machine. By way of example, the printing fluid is a first printing fluid F1. In the illustrated example, the substrate is a first substrate S1, for instance paper. In the illustrated example, the setting is K1 (i.e. F1 and S1), ICC and M1. The combination K1 may also comprise a halftone.

Step b): preparing (b) the printing operation of a second print job 4 involving a change W of the printing fluid and/or of the substrate (and/or the halftone) to a second combination K2 of printing fluid and substrate (and/or halftone). In the illustrated example, the first printing fluid F1 remains the same and the substrate changes to a second substrate S2, i.e. a different paper. Alternatively, other changes may be made, for instance from F1 to F2 while S1 remains unchanged or from F1 to F2 and from S1 to S2. Even more than just two printing fluids or substrates may be available for the change W: i.e. a number n of different printing fluids and a number m of different substrates (with n>1 and m>1).

Step b comprises step parts b1 to b5, optionally to b5a or b5b.

Step part b1): printing b1 a test print 4 on the printing machine 1, the test print 4 including a plurality of test fields 5, using the second combination K2 of printing fluid and substrate, the specified ICC profile ICC, and the first machine setting M1. The test print 4 may comprise a media wedge 11 such as a Fogra media wedge.

Step part b2): recording b2 all or at least a selection of the test fields 5 (and/or of the media wedge 11) of the test print 4 using a device for recording 6 such as a camera or a spectrometer. The result of the recording, e.g. a camera image, is preferably transmitted to a digital computer 7.

Step part b3): computationally determining and saving b3 a quality value GW on the basis of the recorded test fields 5 (and/or of the recorded media wedge 11). This may be done by means of the digital computer 7 (or, alternatively: by means of a further digital computer).

Step part b4): computationally determining and saving b4 at least one adjustment value EW for a machine setting; in the illustrated example, it is for a second machine setting M2 (cf. step part b5). This may be done by means of the digital computer 7 (or, alternatively: by means of the further digital computer).

Step part b5): selectively changing b5 a setting of the printing machine 1 from the first machine setting M1 to a second machine setting M2 using the adjustment value EW or selectively keeping b5 the first machine setting M1 of the printing machine 1; the choice is made as a function of the quality value GW. This may be done by means of the digital computer 7 (or, alternatively, by means of the/a further digital computer). In the illustrated example, the machine setting is changed from setting M1 to setting M2 as a function of the quality value GW. More than two machine settings may be available for the change: i.e. a number k of different machine settings (with k>1). For example, the change may be made if the quality value exceeds a specified threshold.

The second machine setting M2 may comprise changing the volume of the printing ink or the volume of at least one printing ink of the set of printing inks compared to the first machine setting M1 and the change may be made using the adjustment value EW. The adjustment value may for instance be the value of the change (i.e. relative) or the new value to be set (absolute).

Optional step part b5a (in the case of a printing machine using printing masters, for instance in offset printing): creating a second printing forme 8 or a set of second printing formes 8. The second printing forme or set of second printing formes may be created in such a way that it transfers the modified volume of printing ink to the substrate. The creation may comprise exposure in a platesetter 9 using the adjustment value EW or a value corresponding to the latter.

Optional step part b5b (in the case of a printing machine using printing heads, for example in inkjet printing): Changing the calibration of the printing heads 10 in the printing machine 1.

Step c): Printing c the second print job 3 on the printing machine 1 using the second combination K2 of printing fluid and substrate, the specified ICC profile, and—depending on what was chosen in step b)—the first machine setting M1 or the second machine setting M2. In the illustrated example, the setting is K2 (i.e. F1 and S2), ICC, and M2. The combination K2 may also comprise a halftone, in particular a modified halftone.

Figure 3:
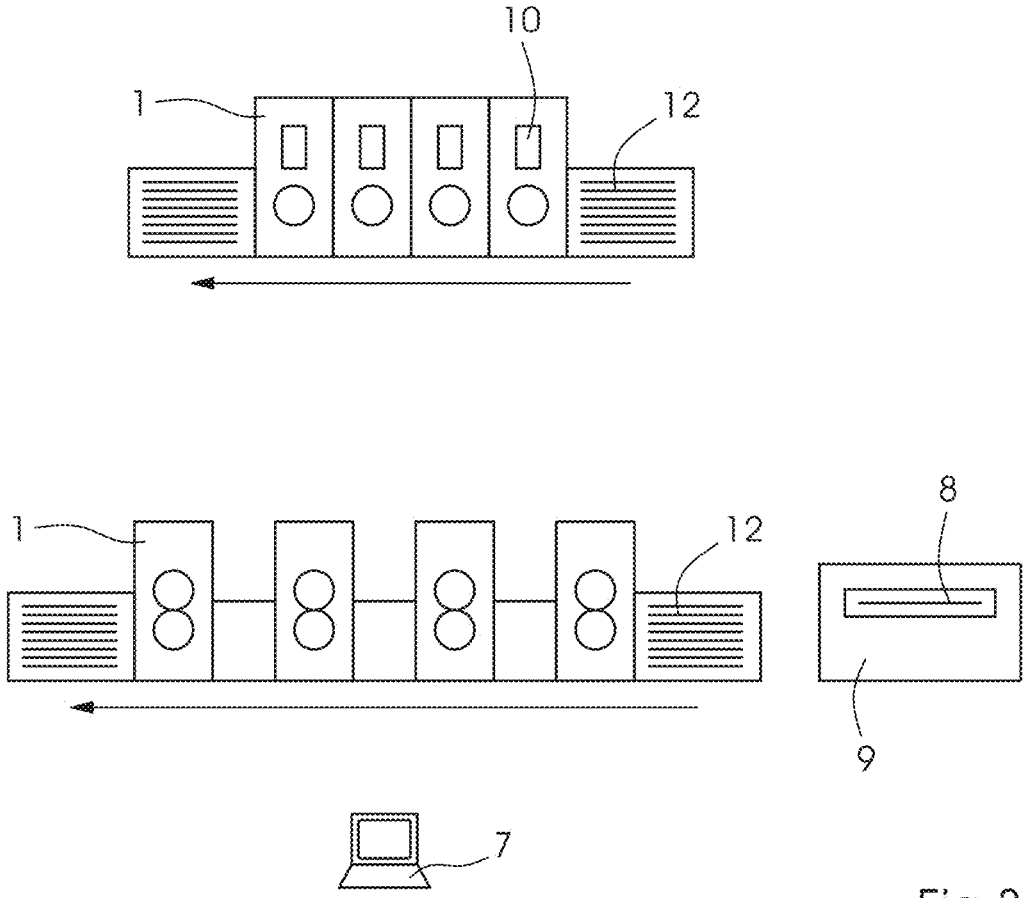
FIG. 3 is an illustration of a preferred exemplary embodiment of the printing machine.

FIG. 3 illustrates a device implementing a preferred exemplary embodiment of the method of the invention. What is used is a printing machine 1—either a printing press (shown at the bottom of FIG. 3, e.g. an offset printing press) using printing formes 8; or a printing machine with printing heads 10 (shown at the top of FIG. 3; for instance an ink printing machine). The printing machine is controlled by the digital computer 7 or a further digital computer. (As indicated by the illustrated arrow) the printing machine conveys and processes substrates 12. In the illustrated example, the substrates 12 are sheets taken from a stack; alternatively, the substrate may be a web on a reel.

Figure 4:
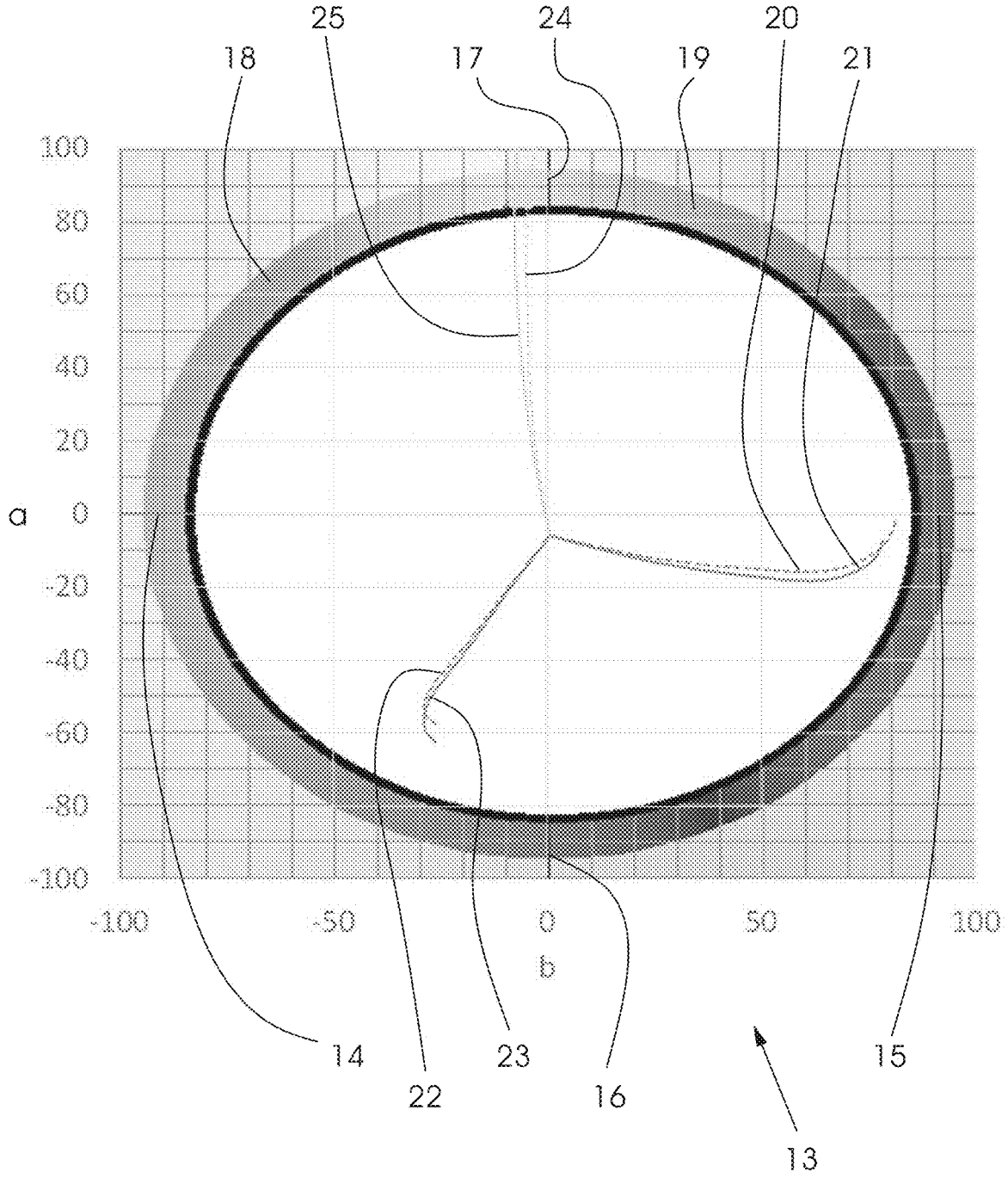
FIG. 4 is a diagram illustrating a color gradation in what is referred to as the a-b plane.

FIG. 4 is a diagram 13 which illustrates the color gradation in what is referred to as the a-b plane. The following colors, i.e. their approximate locations in the diagram are shown by way of example: cyan 14, magenta 15, blue 16, yellow 17, green 18, and orange 19.

Diagram 13 further includes graphs 20 to 25 for specific colors. The thickness of the layer of the ink of the respective color increases along the associated graph in an outward direction from the center. The following graphs are shown: a cyan graph 20, a cyan graph* 21, a blue graph 22, a blue graph* 23, a yellow graph 24, and a yellow graph* 25. Graphs 20, 22, and 24 without the asterisk ("*") apply to the first print job and graphs 21, 23, 25 with the asterisk apply to the second print job. Graphs 21, 23, and 25 may preferably have been created using the analyzed test print, i.e. the test fields and/or media wedge, for instance.

For example, to find the optimum color target value for a solid cyan area, the cyan graph* 21 is examined to find and then select the location which is closest to the color target value of a solid cyan area on cyan graph 20 (minimum distance deltaE). A definition to determine the distance deltaE may be specified (for instance a mathematical method known for this purpose). The same applies to blue and yellow, and special colors, if they are present.

The machine may be controlled in a closed control loop in accordance with target value specifications from the ICC profile. Alternatively, a model-based adaptation of the target values to the substrate may be done and the control may be in accordance with these target values.

The following is an example of the determination of the adjustment/calibration (for instance on the basis of a Fogra media wedge):

measuring of an individual color halftone and/or of multicolor halftones;

calculating an optimized "characteristic printing forme curve" (if printing formes are used) or "characteristic calibration curve" (if printing heads are used) for every measuring field and every color;

optimization, for instance in accordance with one of the following algorithms:

a) averages of the calibration per color;

b) weighted average per color; and c) minimization of the remaining color deviation deltaE.

The following is a summary list of reference numerals and the corresponding structure used in the above description of the invention:

1 printing machine
2 first print job
3 second print job
4 test print
5 plurality of test fields
6 recording device, in particular camera or spectrometer
7 digital computer
8 printing formes
9 platesetter
10 printing heads
11 media wedge
12 substrate
13 diagram "color gradation in the a-b plane"
14 cyan
15 magenta
16 blue
17 yellow
18 green
19 orange
20 "cyan old" graph
21 "cyan new" graph
22 "blue old" graph
23 "blue new" graph
24 "yellow old" graph
25 "yellow new" graph
F1 first printing fluid, in particular printing ink
F2 second printing fluid, in particular printing ink
S1 first substrate, in particular sheet
S2 second substrate, in particular sheet
K1 first combination of printing fluid and substrate
W printing fluid and/or substrate change
K2 second combination of printing fluid and substrate
ICC specified ICC profile
M1 first machine setting
M2 second machine setting
GW quality value
EW adjustment value
a printing the first print job
b preparing the second print job
b1 printing the test print
b2 recording all or at least a selection of the test fields
b3 computationally determining and saving a quality value b4 computationally determining and saving at least one adjustment value b5 selectively changing or keeping a setting of the printing machine b5a creating a second printing forme or a set of second printing formes b5b changing the calibration of the printing heads C printing the second print job

The invention claimed is:

1. A method for printing at least two print jobs on one printing machine, which comprises the steps of:

a) printing a first print job on the printing machine using a first combination of a printing fluid and a substrate, a specified international color consortium (ICC) profile, and a first machine setting of the printing machine;

b) preparing a printing operation for a second print job involving a change of the printing fluid and/or of the substrate to a second combination of the printing fluid and the substrate, wherein step b) includes the sub steps of:

b1) printing a test print on the printing machine, the test print including a plurality of test fields, using the second combination of the printing fluid and the substrate, the specified ICC profile, and the first machine setting;

b2) recording all or at least a selection of the test fields of the test print using a recording device;

b3) computationally determining and saving a quality value on a basis of the test fields recorded;

b4) computationally determining and saving at least one adjustment value for a machine setting; and b5) selectively changing a printing machine setting from the first machine setting to a second machine setting using the at least one adjustment value or selectively keeping the first printing machine setting, and making a choice of the printing machine setting in dependence on the quality value; and c) printing the second print job on the printing machine using the second combination of the printing fluid and the substrate, the specified ICC profile, and in accordance with the choice made in step b), the first machine setting or the second machine setting.

2. The method according to claim 1, wherein the printing fluid is selected from the group consisting of: a first printing fluid being a first offset printing ink or a first set of offset printing inks, and a second printing fluid being a second offset printing ink or a second set of offset printing inks.

3. The method according to claim 2, wherein the second machine setting comprises changing a volume of at least one of the first or second offset printing inks or a volume of at least one printing ink of at least one of the first or second set of printing inks compared to the first machine setting, wherein the changing step involves using the at least one adjustment value.

4. The method according to claim 1, wherein the substep b5) further comprises creating a second printing forme or a set of second printing formes.

5. The method according to claim 4, wherein the second printing forme or the set of second printing formes is created such that a modified volume of the printing fluid is applied to the substrate.

6. The method according to claim 5, wherein the creating step comprises exposing the second printing forme using the at least one adjustment value or a value corresponding to or calculated from the at least one adjustment value.

7. The method according to claim 4, wherein the second printing forme or the set of second printing formes is used in the step c).

8. The method according to claim 1, wherein the printing fluid is selected from the group consisting of: a first printing fluid being a first inkjet printing ink or a first set of inkjet printing inks, and a second printing fluid being a second inkjet printing ink or a second set of inkjet printing inks.

9. The method according to claim 8, wherein the second machine setting comprises a change of a volume of at least one of the first and second inkjet printing inks or of a volume of at least one inkjet printing ink of the first or second set of inkjet printing inks compared to the first machine setting, the change involving the at least one adjustment value.

10. The method according to claim 9, wherein the substep b5) includes changing a calibration of printing heads of the printing machine.

* * * * *